US009271891B2

(12) United States Patent
Andersen et al.

(10) Patent No.: US 9,271,891 B2
(45) Date of Patent: Mar. 1, 2016

(54) WALKER SEAT

(71) Applicant: Medline Industries, Inc., Mundelein, IL (US)

(72) Inventors: Margaret M. Andersen, Chicago, IL (US); Brendan Fong, Northbrook, IL (US); Ben Wang, Zhongshan (CN)

(73) Assignee: Medline Industries, Inc., Mundelein, IL (US)

( * ) Notice: Subject to any disclaimer, the term of this patent is extended or adjusted under 35 U.S.C. 154(b) by 38 days.

(21) Appl. No.: 14/159,178

(22) Filed: Jan. 20, 2014

(65) Prior Publication Data

US 2015/0202100 A1 Jul. 23, 2015

(51) Int. Cl.
*A61H 3/00* (2006.01)

(52) U.S. Cl.
CPC ..... *A61H 3/00* (2013.01); *A61H 2003/004* (2013.01); *A61H 2201/1633* (2013.01); *Y10T 29/49826* (2013.01)

(58) Field of Classification Search
CPC ..... A61H 3/00; A61H 2201/1633; A61H 2003/004
USPC ..... 135/66, 67; 297/5, 6, 129, 217, 1, 250.1
See application file for complete search history.

(56) References Cited

U.S. PATENT DOCUMENTS

| | | | | | |
|---|---|---|---|---|---|
| 2,798,533 | A * | 7/1957 | Frank | 297/6 |
| 3,354,893 | A * | 11/1967 | Schmerl | 135/67 |
| 3,957,071 | A * | 5/1976 | Kenner | 135/66 |
| 4,850,641 | A * | 7/1989 | Walker | 297/6 |
| 5,273,063 | A * | 12/1993 | Farr et al. | 135/66 |
| 5,353,824 | A * | 10/1994 | Woods et al. | 135/66 |
| 5,642,748 | A * | 7/1997 | Obitts | 135/66 |
| 5,904,168 | A * | 5/1999 | Alulyan | 135/65 |
| 6,371,142 | B1 * | 4/2002 | Battiston | 135/67 |
| 2008/0121258 | A1 * | 5/2008 | Lin | 135/67 |

* cited by examiner

*Primary Examiner* — Noah Chandler Hawk
(74) *Attorney, Agent, or Firm* — McAndrews, Held & Malloy, Ltd.

(57) ABSTRACT

A walker seat may include a seat bottom and a support structure. The seat bottom may include an anterior region, a posterior region, an upper side, and a lower side. The lower side may include a central segment retention portion. The support structure may include a central segment, a left-side segment, and a right-side segment. The central segment may be retained by the central segment retention portion. The left-side segment may be extendable from a left side of the central segment, whereby the left-side segment extends beyond a left side of the seat bottom. Similarly, the right-side segment may be extendable from a right side of the central segment, whereby the right-side segment extends beyond a right side of the seat bottom.

25 Claims, 5 Drawing Sheets

WALKER SEAT

CROSS REFERENCE TO RELATED APPLICATIONS

[Not Applicable]

FEDERALLY SPONSORED RESEARCH OR DEVELOPMENT

[Not Applicable]

JOINT RESEARCH AGREEMENT

[Not Applicable]

SEQUENCE LISTING

[Not Applicable]

BACKGROUND

This application relates to seating for a walker.

A walker (or walking frame) may be a tool for disabled or elderly people who desire or need additional support to maintain balance or stability while walking. A related device is a rollator. A rollator may have a frame with three or four large wheels, handlebars and a built-in seat, which allows the user to stop and rest when needed. Rollators, however, may generally be more expensive than walkers because of additional features they may have (for example, hand brakes, padded back rest, storage bag, or basket).

Some seats for walkers are known, but such seats may be customized or integrated into a particular walker. Some removable seats are known but they may require complicated or difficult to use hardware and/or may interfere with parts of a walker, such as the hand grips.

Therefore, it may be useful to provide techniques for adapting a walker to have seating options. It may be useful to provide a seat that can be attached and removed to/from a variety of walkers.

Figure 1:
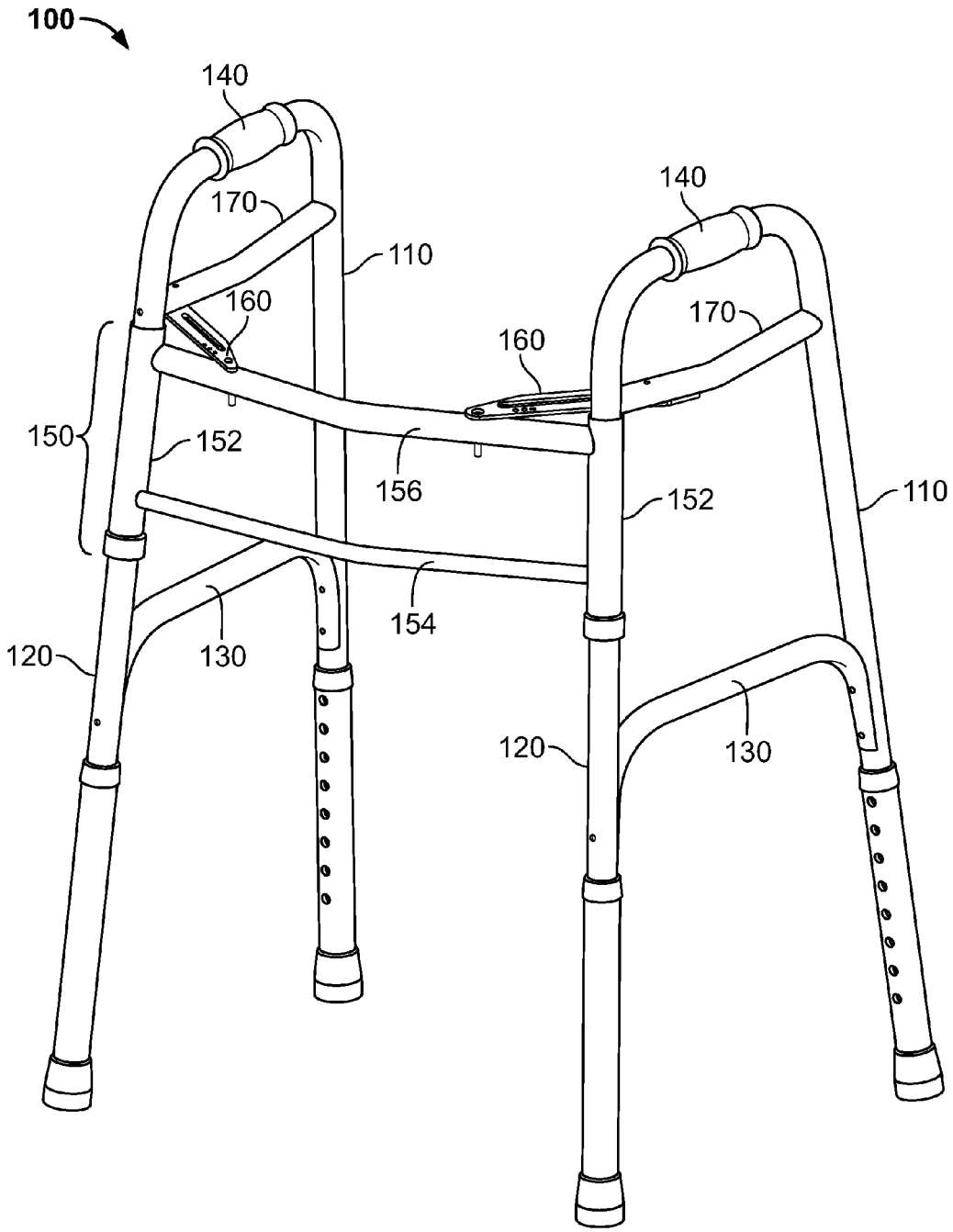
FIG. 1 illustrates a walker.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIG. 1 illustrates a walker 100. The walker 100 may be a collapsible or foldable walker. The walker 100 may include a front portion 150, a left-side portion, and a right-side portion. Each of the left-side and right-side portions may include rear legs 110 and front legs 120 that extend up to handlebars 140. Lower lateral support bars 130 may extend between the front and rear legs 110, 120. Upper lateral support bars 170 may also extend between the front and rear legs 110, 120. The height of the front and rear legs 110, 120 may be adjustable, for example, telescopically.

The front portion 150 may be mechanically coupled with the left-side portion and the right-side portion. The front portion may include hollow tubes 152 on the left and right sides. The hollow tubes 152 may accept the front legs 120 of the left-side portion and the right-side portion, such that the left-side portion and right-side portion may rotate about primary axes of the hollow tubes 152. The hollow tubes 152 may be connected to each other by an upper lateral portion 156 and a lower lateral portion 154. Hinges 160 (for example, releasably lockable hinges) may connect the lateral support bars 170 to the upper lateral portion 156.

Figure 2A:
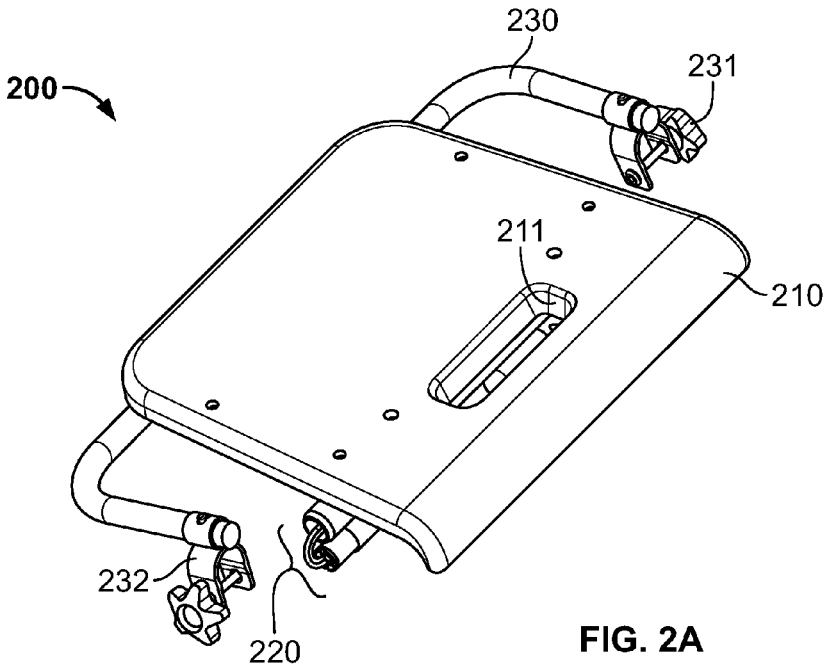
FIG. 2A illustrates a top perspective view of a walker seat assembly, according to certain inventive techniques.
Figure 2B:
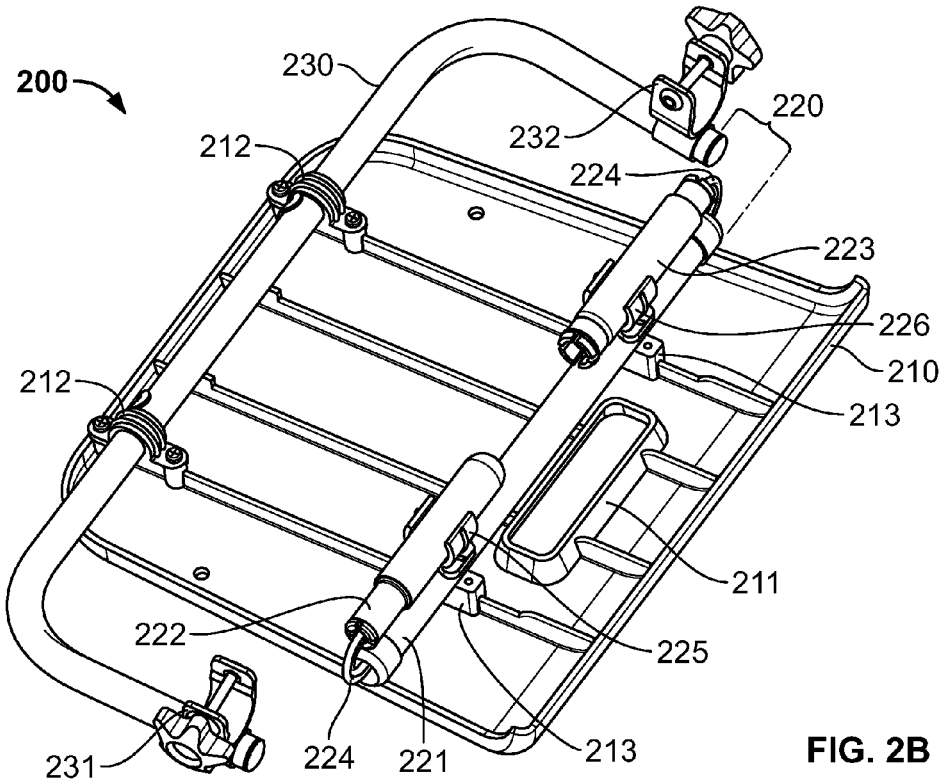
FIG. 2B illustrates a bottom perspective view of a walker seat assembly, according to certain inventive techniques.

FIGS. 2A and 2B illustrate a walker seat assembly 200, according to certain inventive techniques. The walker seat assembly 200 may include a seat bottom 210, a support structure 220, and a mounting member 230. The seat bottom 210 may include an anterior region (proximate the front of the seat), a posterior region (proximate the rear of the seat), an upper side, and a lower side. A user may sit on the upper side. An aperture 211 may be located in the anterior region of the seat bottom 210. The aperture 211 may accept a user's hand to facilitate the user to move or carry the seat bottom 210 and any connected parts.

In its posterior region, the seat bottom 210 may include an attachment portion 212. Note, as used herein, a "portion" may include one or more smaller portions, even when the smaller portions are discontiguous with each other. Thus, as shown, the attachment portion 212 may include two separate portions in the posterior region of the seat bottom 210. The attachment portion 212 is depicted on the bottom of the seat bottom 210 but could also be located on the top of the seat bottom 210. The attachment portion 212 may attach to an additional member separate from the walker seat assembly 200. For example, the attachment portion 212 may attach directly to the walker 100 (for example, attach to the front portion 150 of the walker 100). The attachment portion 212 may also attach to the mounting member 230 as depicted. Once attached, the seat bottom 210 may be able to rotate about the additional member (for example, a part of the walker 100) or mounting member 230.

The mounting member 230 may include an elongated portion with a left and right side. The elongated portion may be U-shaped. A left-side mounting structure 231 may be on the left side of the elongated portion. A right-side mounting structure 232 may be on the right side of the elongated portion. Both the left-side and right-side mounting structures 231, 232 may be mountable to another structure. For example, the mounting structures may be mounted to the front portion 150 of walker 100. In such an example, the mounting structures may be mounted to the hollow tubes 152 (See FIGS. 3A and 3B).

The support structure 220 may include a central segment 221, a right-side segment 222, a left-side segment 223, one or more springs 224, a right-side segment retention portion 225 and a left-side segment retention portion 226. The support structure 220 may be attachable or retainable to the seat bottom 210 with a central segment retention portion 213. The central segment retention portion 213 may be located on the bottom side and the anterior region of the seat bottom 210. The central segment retention portion 213 may retain the central segment 221 (for example, semi-permanently retain the central segment 221 by requiring the use of one or more tools to attach/detach the central segment 221 to/from the seat bottom 210). The central segment 221 may include one or more sections.

The left-side segment retention portion 226 and the right-side segment retention portion 225 may be positioned on the central segment 221 as illustrated in FIG. 2B. As an alternative, the segment retention portions 225, 226 may be located on the bottom side of the seat bottom 210. The left-side segment retention portion 226 is configured to retain the left-side segment 223. The right-side segment retention portion 225 is configured to retain the right-side segment 222. The segment retention portions 225, 226 may releasably retain the segments 222, 223. For example, a user may be able to readily attach and detach the segments 222, 223 from the segment retention portions 225, 226 by hand and without any tools.

The right-side segment 222 may be extendable from a right side of the central segment 221. For example, the right-side segment 222 may engage with a right side of the central segment 221 such that the right-side segment 222 extends beyond a right side of the seat bottom 210. The right-side segment 222 may be removably engageable with the central segment 221. For example, a user may be able to readily engage and disengage the right-side segment 222 from the central segment 221 by hand and without any tools. The right side of the central segment 221 may include a female portion, while the right-side segment 222 may include a male portion configured to mate with the female portion of the central segment 221. Conversely, the right side of the central segment 221 may include a male portion, while the right-side segment 222 may include a female portion configured to mate with the male portion of the central segment 221.

The left-side segment 223 may be extendable from a left side of the central segment 221. For example, the left-side segment 223 may engage with a left side of the central segment 221 such that the left-side segment 223 extends beyond a left side of the seat bottom 210. The left-side segment 223 may be removably engageable with the central segment 221. For example, a user may be able to readily engage and disengage the left-side segment 223 from the central segment 221 by hand and without any tools. The left side of the central segment 221 may include a female portion, while the left-side segment 223 may include a male portion configured to mate with the female portion of the central segment 221. Conversely, the left side of the central segment 221 may include a male portion, while the left-side segment 223 may include a female portion configured to mate with the male portion of the central segment 221.

The right-side segment 222 may be attached to a spring 224 (for example, permanently or semi-permanently attached to the spring). The spring 224 may also be attached to the central segment 221. The spring 224 may, therefore, couple the right-side segment 222 to the central segment 221. The spring 224 may be or may include, for example, an elastic cord. The spring 224 may tend to pull the right-side segment 222 towards or into the central segment 221.

The left-side segment 223 may be attached to a spring 224 (for example, permanently or semi-permanently attached to the spring). The spring 224 may also be attached to the central segment 221. The spring 224 may, therefore, couple the left-side segment 223 to the central segment 221. The spring 224 may be or may include, for example, an elastic cord. The spring 224 may tend to pull the left-side segment 223 towards or into the central segment 221.

According to certain inventive techniques, the right-side segment 222 and the left-side segment 223 may be attached to the same spring 224. In this arrangement, the spring 224 may extend through a hollow region in the central segment 221.

According to certain inventive techniques, the right-side segment 222, the left-side segment 223, and the central segment 221 may be configured in a telescoping arrangement (not shown). For example, the right-side segment 222 may telescopically extend from the right side of the central segment 221, and the left-side segment 223 may telescopically extend from the left side of the central segment 221.

Figure 3B:
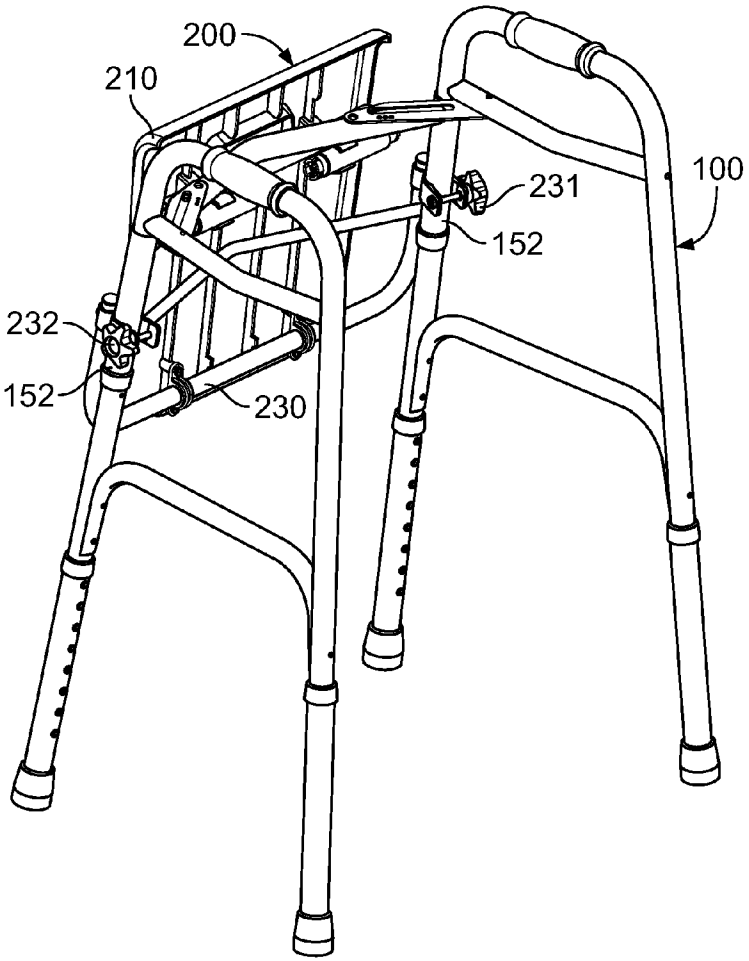
FIGS. 3A and 3B illustrate front and rear perspective views of the walker and walker seat assembly in a first position, according to certain inventive techniques.
Figure 3A:
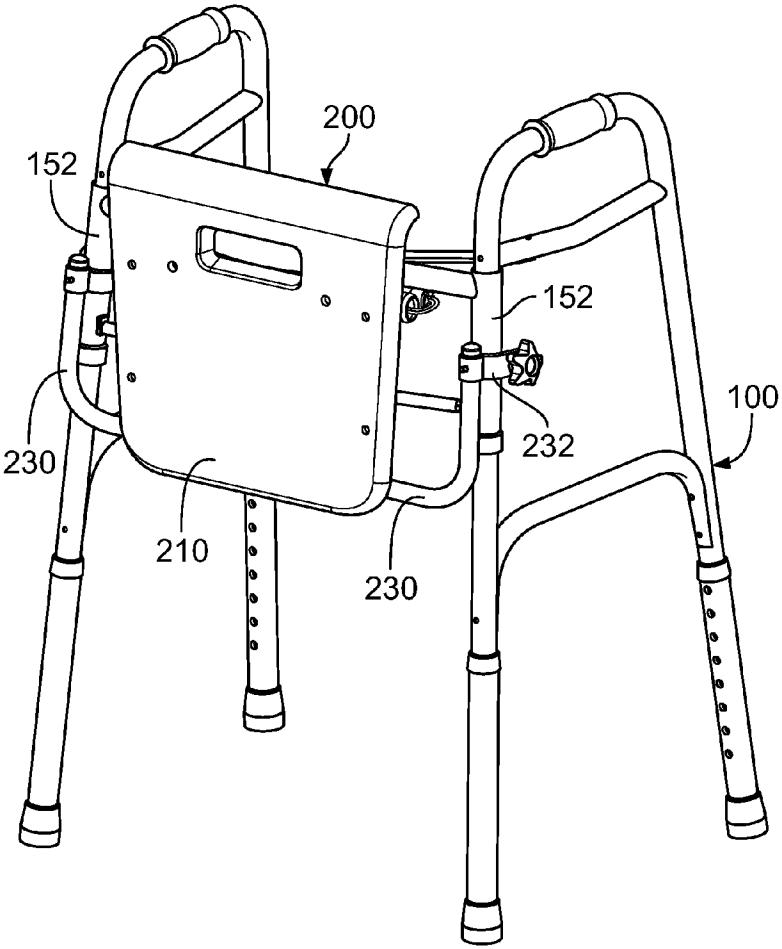

FIGS. 3A and 3B illustrate front and rear perspective views of the walker 100 and walker seat assembly 200 in a first position, according to certain inventive techniques. As shown, the mounting member 230 of the seat assembly 200 is attached to the walker 100. The mounting member 230 may be attached to the hollow portions 152 of the walker with the right-side and left-side mounting structures 231, 232. In the first position, the seat bottom 210 may be substantially on the front side of walker 100 and may have a substantially vertical arrangement. In the first position, the left-side segment 223 and the right-side segment 222 may not extend past the left and right sides of the seat bottom 210 and may be retained by the left-side segment retention portion 226 and the right-side segment retention portion 225.

Figure 3C:
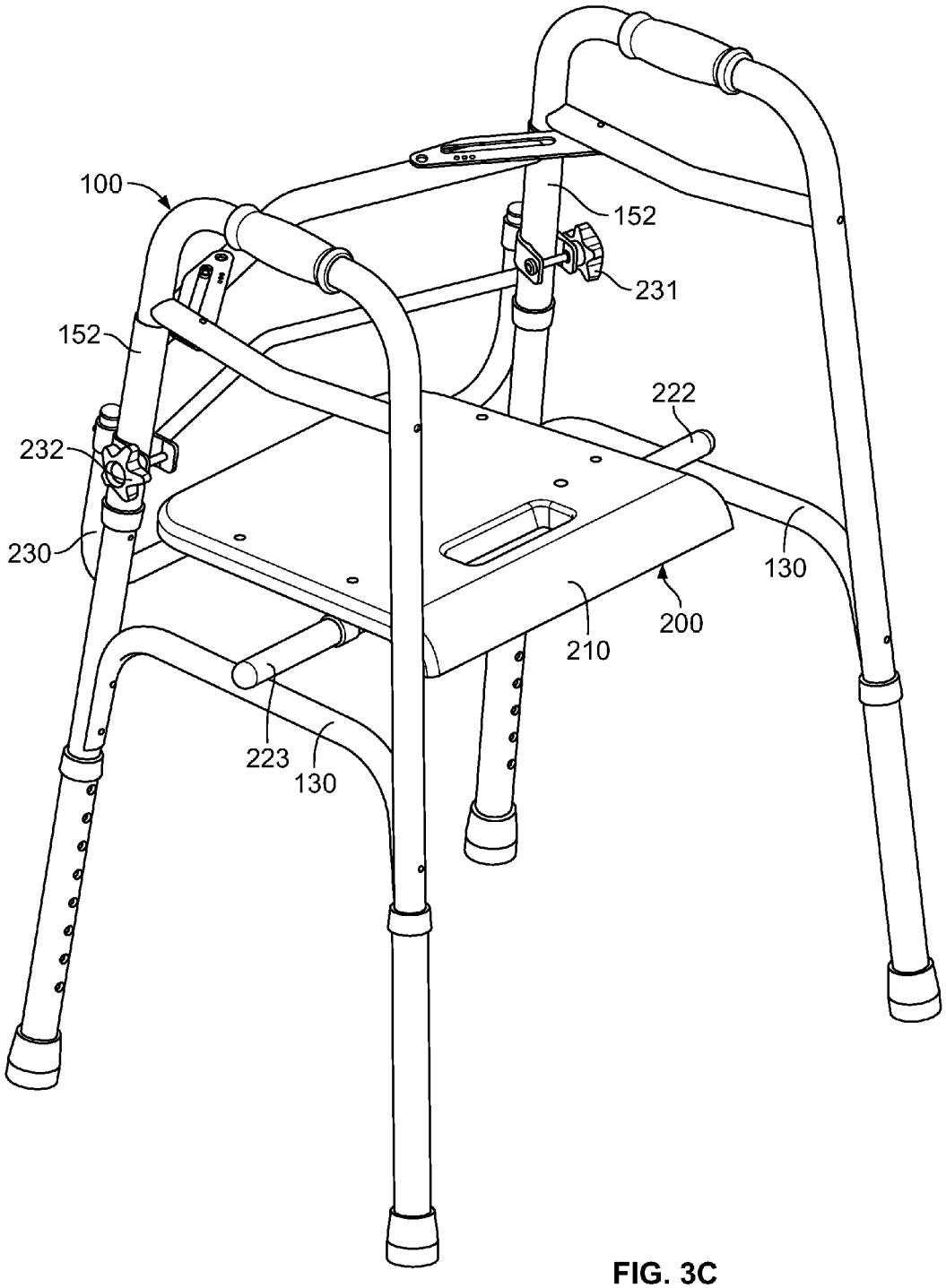
FIG. 3C illustrates a rear perspective view of the walker and walker seat assembly in a second position, according to certain inventive techniques.

FIG. 3C illustrates a rear perspective view of the walker 100 and walker seat assembly 200 in a second position, according to certain inventive techniques. While the mounting member 230 is still mounted to the hollow portions 152 of the walker 100, the seat bottom may have a substantially horizontal arrangement and may be located substantially behind the front of the walker 100. The right-side segment 222 and the left-side segment 223 may be engaged with the central segment 221 and may extend beyond the right and left sides of the seat bottom 210. The right-side and left-side segments 222, 223 may rest on the lower lateral support bars 130 of the walker 100.

Figure 4B:
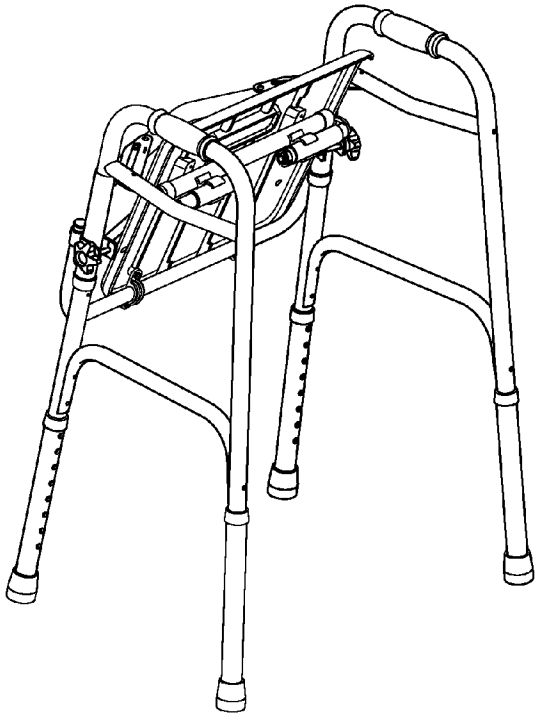
FIGS. 4A-4C illustrate a technique for operating a walker seat assembly attached to a walker, according to certain inventive techniques.
Figure 4C:
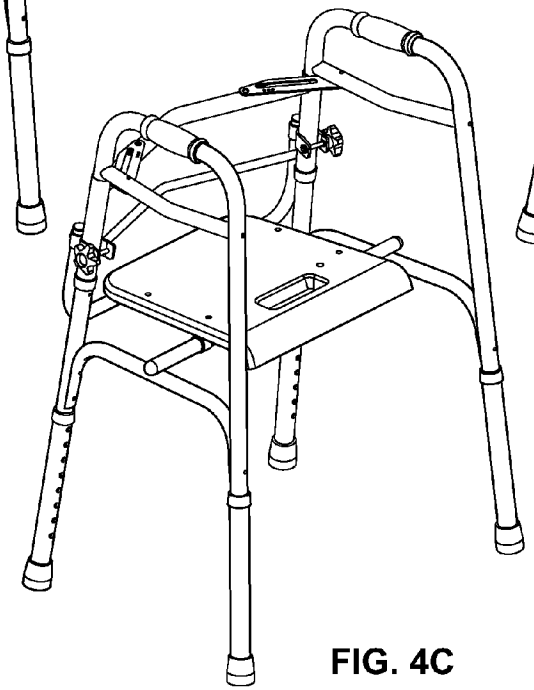
Figure 4A:
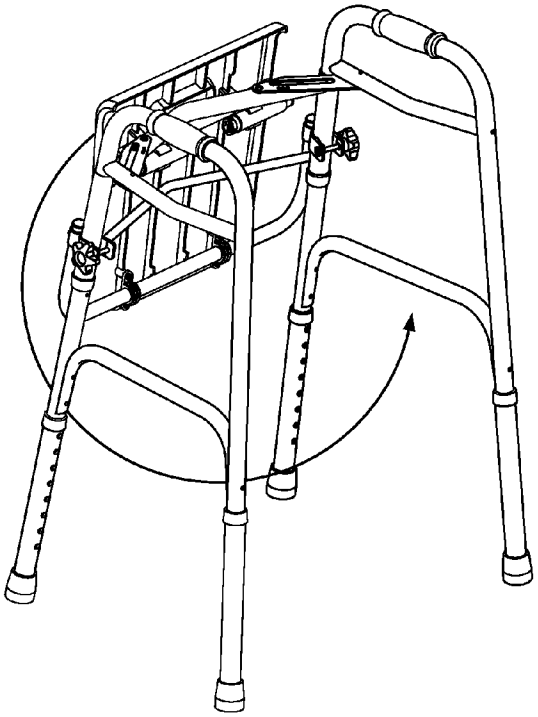

FIGS. 4A-4C illustrate a technique for operating the walker seat assembly 200 attached to a walker 100, according to certain inventive techniques. As an initial step, the walker seat assembly 200 may be attached to the walker 100 using mounting portions 231 and 232 on the mounting member 230. The mounting portions 231, 232 may include C-clamps or other types of clamps. The mounting portions 231, 232 may clamp on to the hollow portions 152 of the walker 100. For example, the mounting portions 231, 232 may snap on to the walker 100 and, having been snapped in, the mounting portions 231, 232 may be further tightened using adjustment knobs.

FIG. 4A depicts a rear perspective view of the walker 100 and walker seat assembly 200 in the first position, in which the seat bottom 210 has a substantially vertical arrangement. The arrow depicts a degree of motion of the seat bottom 210 of the walker seat assembly 200 with respect to the walker 100. As shown, the seat bottom 210 can rotate counterclockwise about the elongated portion of the mounting member 230. The seat bottom 210 may be rotatable more than 180 degrees—for example, 270 degrees or more. In the first position, the left-side segment 223 and the right-side segment 222 may not extend past the left and right sides of the seat bottom 210 and may be retained by the left-side segment retention portion 226 and the right-side segment retention portion 225.

Proceeding next to FIG. 4B, the seat bottom 210 may be rotated past a second position. The left-side segment 223 and the right-side segment 222 may be extended past the left and right sides of the seat bottom 210. According to certain inventive techniques, the left-side and right-side segments 222, 223 may be disengaged from the segment retention portions 225, 226. This disengagement may be performed by hand and without the need of any tool. The left-side and right-side segments 222, 223 may then be rotated (for example, rotated approximately 180 degrees) and engaged with the ends of the central segment 221, such that the right-side and left-side segments 222, 223 extend laterally past the left and right sides of the seat bottom 210. At this stage, the support structure 220 (including right-side and left-side segments 222, 223) may be above the lower lateral support bars 130 of the walker 100.

Alternatively, the support structure 220 may include right-side and left-side segments 222, 223 that extend telescopically from the central segment 221. The segments may be extended such that they extend laterally past the left and right sides of the seat bottom 210.

Proceeding next to FIG. 4C, the seat bottom 210 is lowered down into the second position such that the right-side and left-side segments 222, 223 of the support structure rest on portions of the left side and right side of the walker 100 (for example, the lower lateral support bars 130 of the walker 100 as depicted). The user now has positioned the seat bottom 210 in a substantially horizontal arrangement, which is comfortable for sitting.

The process may then be reversed to return the seat bottom 210 to the first position depicted in FIG. 4A. After resting the right-side and left-side segments 222, 223 of the support structure 220 on the right side of the walker and a left side of the walker, the seat bottom 210 is raised upwardly such that the right-side and left-side segments 222, 223 of the support structure 210 are above the left side of the walker and the right side of the walker 100 (for example, the lower lateral support bars 130 of the walker 100 as depicted).

The support structure 220 may then be collapsed. According to certain inventive techniques, the right-side and left-side segments 222, 223 are disengaged from the right and left ends of the central segment 221. The right-side and left-side segments 222, 223 are then each rotated (for example, approximately 180 degrees) and engaged with the segment retention portions 225, 226. The seat bottom 210 may then be rotated about the walker by more than 180 degrees (for example, approximately 270 degrees) from the second position to the first position depicted in FIG. 4A.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. An apparatus comprising:
- a seat bottom including:
  - an anterior region;
  - a posterior region;
  - an upper side; and
  - a lower side including a central segment retention portion; and
- a support structure including:
  - a central segment retained by the central segment retention portion;
  - a left-side segment extendable from a left side of the central segment, whereby the left-side segment extends beyond a left side of the seat bottom, wherein the left-side segment is removably engageable with the left side of the central segment;
  - a right-side segment extendable from a right side of the central segment, whereby the right-side segment extends beyond a right side of the seat bottom, wherein the right-side segment is removably engageable with the right side of the central segment; and
  - a spring extending through the central segment, attached to the left-side segment, and attached to the right-side segment, wherein the spring comprises an elastic cord.

2. The apparatus of claim 1, wherein the central segment retention portion is located in the anterior region of the seat bottom.

3. The apparatus of claim 1, wherein the seat bottom further comprises an attachment portion in the posterior region of the seat bottom and configured to attach to an additional member, such that the seat bottom can rotate about the additional member.

4. The apparatus of claim 1, further comprising:
- a left-side segment retention portion configured to releasably retain the left-side segment; and
- a right-side segment retention portion configured to releasably retain the right-side segment,
- wherein the right-side segment retention portion and the left-side segment retention portion are located on at least one of the lower side of the seat bottom or the central segment.

5. The apparatus of claim 4, wherein the right-side segment retention portion and the left-side segment retention portion are located on the central segment.

6. The apparatus of claim 1, wherein:
- the left side of the central segment includes a female portion;
- the right side of the central segment includes a female portion;
- the left-side segment includes a male portion configured to mate with the female portion of the left side of the central segment; and
- the right-side segment includes a male portion configured to mate with the female portion of the right side of the central segment.

7. A method for operating a walker with a seat assembly, wherein the seat assembly includes a seat bottom and a support structure, and wherein the method comprises:
- while the seat assembly is attached to the walker, rotating the seat bottom about the walker by more than 180 degrees from a first position;
- extending the support structure from underneath the seat bottom to extend laterally past a left-side edge of the seat bottom and laterally past a right-side edge of the seat bottom;
- resting the extended portions of the support structure on a right side of the walker and a left side of the walker to form a second position; and
- wherein:
  - the seat bottom has a substantially vertical arrangement and is in front of the walker when the seat bottom is in the first position; and the seat bottom has a substantially horizontal arrangement and is behind a front of the walker when the seat bottom is in the second position.

8. The method of claim 7, further comprising attaching the seat assembly to the walker by mounting the seat assembly to the walker on the left side of the walker and on the right side of the walker.

9. The method of claim 7, further comprising:

after said resting the extended portions of the support structure on a right side of the walker and a left side of the walker, raising the extended portions of the support structure off of the left side of the walker and the right side of the walker;

collapsing the support structure such that the support structure no longer extends laterally past the left-side edge of the seat bottom and laterally past the right-side edge of the seat bottom; and while the seat assembly is attached to the walker, rotating the seat bottom about the walker by more than 180 degrees from the second position to the first position.

10. An apparatus comprising:

a mounting member including:

an elongated portion having a left side and a right side;

a left-side mounting structure on the left side of the elongated portion, wherein the left-side mounting structure is mountable to a walker; and a right-side mounting structure on the right side of the elongated portion, wherein the right-side mounting structure is mountable to the walker;

a seat bottom including:

an anterior region;

a posterior region;

an upper side;

a lower side including a central segment retention portion in the anterior region; and an attachment portion rotatably attached to the elongated portion of the mounting member; and a support structure including:

a central segment retained by the central segment retention portion;

a left-side segment extendable from a left side of the central segment, whereby the left-side segment extends beyond a left side of the seat bottom, wherein the left-side segment is removably engageable with the left side of the central segment;

a right-side segment extendable from a right side of the central segment, whereby the right-side segment extends beyond a right side of the seat bottom, wherein the right-side segment is removably engageable with the right side of the central segment; and a spring extending through the central segment, attached to the left-side segment, and attached to the right-side segment, wherein the spring comprises an elastic cord.

11. The apparatus of claim 10, wherein the elongated portion comprises a U-shape.

12. The apparatus of claim 10, further comprising:

a left-side segment retention portion configured to releasably retain the left-side segment; and a right-side segment retention portion configured to releasably retain the right-side segment, wherein the right-side segment retention portion and the left-side segment retention portion are located on at least one of the lower side of the seat bottom or the central segment.

13. The apparatus of claim 12, wherein the right-side segment retention portion and the left-side segment retention portion are located on the central segment.

14. The apparatus of claim 10, wherein:

the left side of the central segment includes a female portion;

the right side of the central segment includes a female portion;

the left-side segment includes a male portion configured to mate with the female portion of the left side of the central segment; and the right-side segment includes a male portion configured to mate with the female portion of the right side of the central segment.

15. An apparatus comprising:

a seat bottom including:

an anterior region;

a posterior region;

an upper side; and a lower side including a central segment retention portion; and a support structure including:

a central segment retained by the central segment retention portion;

a left-side segment extendable from a left side of the central segment, whereby the left-side segment extends beyond a left side of the seat bottom, and wherein the left-side segment is removably engageable with the left side of the central segment;

a right-side segment extendable from a right side of the central segment, whereby the right-side segment extends beyond a right side of the seat bottom, wherein the right-side segment is removably engageable with the right side of the central segment;

a left-side segment retention portion configured to releasably retain the left-side segment and located on the central segment; and a right-side segment retention portion configured to releasably retain the right-side segment and located on the central segment.

16. The apparatus of claim 15, wherein the central segment retention portion is located in the anterior region of the seat bottom.

17. The apparatus of claim 15, wherein the seat bottom further comprises an attachment portion in the posterior region of the seat bottom and configured to attach to an additional member, such that the seat bottom can rotate about the additional member.

18. The apparatus of claim 15, wherein:

the left-side segment is removably engageable with the left side of the central segment; and the right-side segment is removably engageable with the right side of the central segment.

19. The apparatus of claim 18, wherein:

the left side of the central segment includes a female portion;

the right side of the central segment includes a female portion;

the left-side segment includes a male portion configured to mate with the female portion of the left side of the central segment; and the right-side segment includes a male portion configured to mate with the female portion of the right side of the central segment.

20. The apparatus of claim 15, wherein the left-side segment, right-side segment, and central segment comprise a telescoping arrangement.

21. An apparatus comprising:

a mounting member including:

an elongated portion having a left side and a right side;

a left-side mounting structure on the left side of the elongated portion, wherein the left-side mounting structure is mountable to a walker; and a right-side mounting structure on the right side of the elongated portion, wherein the right-side mounting structure is mountable to the walker;

a seat bottom including:

an anterior region;

a posterior region;

an upper side;

a lower side including a central segment retention portion in the anterior region; and an attachment portion rotatably attached to the elongated portion of the mounting member; and a support structure including:

a central segment retained by the central segment retention portion;

a left-side segment extendable from a left side of the central segment, whereby the left-side segment extends beyond a left side of the seat bottom, and wherein the left-side segment is removably engageable with the left side of the central segment; and a right-side segment extendable from a right side of the central segment, whereby the right-side segment extends beyond a right side of the seat bottom, and wherein the right-side segment is removably engageable with the right side of the central segment;

a left-side segment retention portion configured to releasably retain the left-side segment and located on the central segment; and a right-side segment retention portion configured to releasably retain the right-side segment and located on the central segment.

22. The apparatus of claim 21, wherein the elongated portion comprises a U-shape.

23. The apparatus of claim 21, wherein:

the left-side segment is removably engageable with the left side of the central segment; and the right-side segment is removably engageable with the right side of the central segment.

24. The apparatus of claim 23, wherein:

the left side of the central segment includes a female portion;

the right side of the central segment includes a female portion;

the left-side segment includes a male portion configured to mate with the female portion of the left side of the central segment; and the right-side segment includes a male portion configured to mate with the female portion of the right side of the central segment.

25. The apparatus of claim 21, wherein the left-side segment, right-side segment, and central segment comprise a telescoping arrangement.

* * * * *